US005587432A

United States Patent [19]

Scattergood

[11] Patent Number: 5,587,432

[45] Date of Patent: Dec. 24, 1996

[54] DISPERSANTS FOR LUBRICATING OIL

[75] Inventor: Roger Scattergood, Reading, United Kingdom

[73] Assignee: Ethyl Petroleum Additives Limited, Bracknell, England

[21] Appl. No.: 347,767

[22] Filed: Nov. 30, 1994

[51] Int. Cl.[6] ..... C08F 8/32

[52] U.S. Cl. ..... 525/327.6; 525/381; 508/454

[58] Field of Search ..... 525/327.6; 252/51.5 A

[56] References Cited

U.S. PATENT DOCUMENTS 5,137,980 8/1992 DeGonia et al. ..... 525/327.6
5,241,003 8/1993 DeGonia et al. ..... 525/327.6

FOREIGN PATENT DOCUMENTS

0062714A1 10/1920 European Pat. Off. .
1054280 1/1967 United Kingdom .
1531945 11/1978 United Kingdom .

*Primary Examiner*—Bernard Lipman
*Attorney, Agent, or Firm*—Dennis H. Rainear

[57] ABSTRACT

Novel ashless dispersants that have reduced reactivity toward fluoroelastomers are described. They are oil-soluble products obtained by a process which comprises reacting (i) a long chain succinic acylating agent wherein the long chain is derived from a polyolefin with (ii) an alkoxylated diethylene triamine having an average of from 1 to 2 N-substituted $C_2$ or $C_3$ hydroxyalkyl groups per molecule. These reactants being employed in proportions of at least 2 moles of the acylating agent per mole of the alkoxylated diethylene triamine, with the proviso that where the average of N-substituted $C_2$ or $C_3$ hydroxyalkyl groups is 1.7 or more, the proportions are such that there are more than 2 moles of the acylating agent per mole of the alkoxylated diethylene triamine.

21 Claims, No Drawings

DISPERSANTS FOR LUBRICATING OIL

This invention relates to new and highly useful dispersants for use as additives to natural and synthetic lubricating oils. More particularly this invention relates to novel ashless dispersants that have reduced reactivity toward fluoroelastomers.

A continuing problem in the art of lubrication is to provide lubricant compositions which satisfy the demands imposed upon them by the original equipment manufacturers. One such requirement is that the lubricant satisfy one or more tests for fluoroelastomer degradation under specified laboratory test conditions. The commercial reality is that if the lubricant is unable to pass the applicable test or tests, it is unlikely to meet acceptance in the marketplace. Standard test methods for evaluating fluoroelastomer compatibility of lubricant compositions include the Volkswagen P.VW 3334 Seal Test and the CCMC Viton Seal Test (CEL L-39-T-87 Oil/Elastomer Compatibility Test).

More recently, a new, even more severe fluoroelastomer test procedure has been developed, namely the Volkswagen P.VW 3344 Seal Test. This test is so severe that a variety of commercially-available premium motor oils from various manufacturers have been found to fail this test.

Thus a need has arisen for a dispersant that exhibits reduced antagonism toward fluoroelastomers in at least one of the above standard test procedures. At the same time it is desired that the dispersant be relatively easy to produce at low cost from readily available starting materials.

This invention is deemed to fulfill the foregoing need in an effective and efficient manner. The dispersants of this invention exhibit little antagonism toward fluoroelastomers and most if not all are capable of achieving passing results in one or more of the foregoing test procedures. Moreover, the dispersants are relatively easy to produce at low cost. Indeed, one of the starting materials is currently in widespread use in the manufacture of dispersants and the other starting material can be readily produced from readily available starting materials.

In accordance with this invention there is provided an oil-soluble dispersant obtained by reacting a long chain alkyl or alkenyl succinic acylating agent with an alkoxylated diethylene triamine having an average of from 1 to 2 N-substituted $C_2$ or $C_3$ hydroxyalkyl groups per molecule, the reactants being employed in proportions of at least 2 moles (typically from 2 to 2.8 moles, and preferably from 2 to 2.5 moles) of said acylating agent per mole of said alkoxylated diethylene triamine, with the proviso that where said average of N-substituted $C_2$ or $C_3$ hydroxyalkyl groups is 1.7 or more, said proportions are such that there are more than 2 moles of said acylating agent per mole of said alkoxylated diethylene triamine. Dispersants wherein the hydroxyalkyl groups are hydroxyethyl groups are preferred. It is also preferable that the average number N-substituted hydroxyalkyl groups per molecule of the dispersant fall in the range of 1.1 to 1.6. To achieve particularly good results in the Volkswagen P.VW 3334 Seal Test, the average number of N-substituted hydroxyalkyl groups per molecule of the dispersant is preferably in the range of 1.1 to 1.3, and most preferably is 1.2. On the other hand, to achieve a particularly good balance of seal performance in the more recent Volkswagen P.VW 3344 Seal Test together with dispersancy, the average number of N-substituted hydroxyalkyl groups per molecule of the dispersant is preferably in the range of 1.4 to 1.6, and most preferably is 1.5.

Another embodiment of this invention is an oil-soluble dispersant obtained by subjecting the above-described dispersant to post treatment with a suitable post-treating reagent such as are referred to in Table 4 of U.S. Pat. No. 5,137,980. Preferred as post-treating agents for use in this invention are dicarboxylic acylating agents selected from (a) acyclic dicarboxylic acids having up to 6 carbon atoms in the molecule and wherein the carboxyl groups are attached to adjacent carbon atoms, (b) anhydrides of the said dicarboxylic acids, (c) acyl halides of the said dicarboxylic acids, and (d) acyclic mono- and/or dihydrocarbyl esters of the said dicarboxylic acids having no more than 7 carbon atoms per hydrocarbyl group. Examples of these acylating agents include maleic acid, maleic anhydride, α-ethylmaleic acid, malic acid, fumaric acid, itaconic acid, itaconic anhydride, citraconic acid, citraconic anhydride, succinic acid, succinic anhydride, α-methylsuccinic acid, α,α-dimethylsuccinic acid, α,β-dimethylsuccinic acid, α-ethylsuccinic acid, thiomalic acid, tartaric acid, the monoalkyl esters of the foregoing acids wherein the alkyl group has from 1 to 7 carbon atoms, the dialkyl esters of the foregoing acids wherein each alkyl group has from 1 to 7 carbon atoms, the monoalkenyl esters of the foregoing acids wherein the alkenyl group has from 2 to 7 carbon atoms, the dialkenyl esters of the foregoing acids wherein each alkenyl group has from 2 to 7 carbon atoms, the acyl chlorides of the foregoing acids, and the like. The most preferred post-treating agent for use in the practice of this invention is maleic anhydride.

When employing any of the post-treating agents identified above as (a), (b), (c) and (d), such post-treating agent serves as a supplementary acylating agent for the polyalkenyl succinic acylating agent in providing dispersants exhibiting little antagonism toward fluoroelastomers. Thus in accordance with this embodiment of the invention there is provided an oil-soluble dispersant which is obtained by reacting (i) a long chain alkyl or alkenyl succinic acylating agent with (ii) an alkoxylated diethylene triamine having an average of from 1 to 2 N-substituted $C_2$ or $C_3$ hydroxyalkyl groups per molecule, and reacting the product so formed with (iii) at least one dicarboxylic acylating agent selected from (a) acyclic dicarboxylic acids having up to 6 carbon atoms in the molecule and wherein the carboxyl groups are attached to adjacent carbon atoms, (b) anhydrides of the said dicarboxylic acids, (c) acyl halides of the said dicarboxylic acids, and (d) acyclic mono and/or dihydrocarbyl esters of the said dicarboxylic acids having no more than 7 carbon atoms per hydrocarbyl group, wherein the proportions of (i), (ii) and (iii) are such that there are from 1.5 to 2.5 moles of (i) and from 0.1 to 0.7 mole of (iii) per mole of (ii) with the proviso that per mole of reactant (ii) the total of reactants (i) and (iii) is at least 2 moles, typically from 2.05 to 2.8 moles, and preferably from 2.1 to 2.5 moles.

Any of the dispersants of this invention can be borated, if desired, using processing techniques and borating agents such as are referred to in the applicable patents identified in Table 4 of U.S. Pat. No. 5,137,980. Typically the boron content of the dispersant will be in the range of up to 1.25 weight percent based on the weight of the active dispersant (i.e., excluding from consideration the weight of any diluent oil in which the dispersant may be, and preferably is, dissolved). The preferred boron content on this basis is up to 0.65 weight percent.

Pursuant to still another embodiment of this invention there is provided a composition which comprises from 1 to 99 percent by weight of oil of lubricating viscosity and from 99 to 1 percent by weight of any of the above dispersants of this invention.

Also provided by this invention are lubricant compositions comprising oil of lubricating viscosity and one or more, and preferably all, of the following components: viscosity index improver, metal (most preferably zinc) dialkyl dithiophosphate, alkali or alkaline earth metal detergent (preferably sulfonate, sulfurized phenate and/or salicylate), antioxidant (preferably phenolic, aromatic amine or copper-based), and antifoam agent (preferably silicone-based). Other typical additive components can also be present. For further details including proportions, etc., one need only refer to the literature on the subject, one example being U.S. Pat. No. 5,137,980.

A further embodiment of this invention is the use in a lubricant composition of a dispersant of this invention to minimize fluoroelastomer degradation that generally results on exposure of a fluoroelastomer to a lubricant containing a nitrogen-containing dispersant.

The diethylene triamine used in forming the alkoxylated diethylene triamines employed in producing the dispersants of this invention can be either a highly pure compound or a commercially-available technical grade.

To produce the dispersants of this invention it is only necessary to react a long chain alkyl or alkenyl succinic acylating agent, preferably a polyisobutenyl succinic acylating agent, with an alkoxylated diethylene triamine fulfilling the requirements given above. Such acylating agents are well known materials that have been extensively described and discussed in the literature, such as, for example U.S. Pat. Nos. 3,215,707; 3,219,666; 3,231,587; 3,254,025; 3,282,955; 3,361,673; 3,401,118; 3,912,764; 4,110,349; 4,234,435; 5,071,919 and 5,137,978. In fact, acylating agents of this type are manufactured in large quantities and are in widespread use in the manufacture of dispersants. Preferred acylating agents for use in this invention are derived from a polyalkene having a number average molecular weight as determined by GPC in the range of 900 to 5000. Most preferably they have a number average molecular weight in the range of 1200 to 2500. While homopolymers and copolymers of a variety of 1-olefins can be used for preparing the acylating agents, commercial grades of polyisobutene are the preferred materials. As is also well known, the alkyl or alkenyl succinic acylating agent can be an acyl halide, or a lower alkyl (i.e., a $C_1$ to $C_7$ alkyl) ester, but preferably the acylating agent is used in the form of the free acid and most preferably in the form of a long chain alkenyl succinic anhydride.

The other reactant, the alkoxylated diethylene triamine can be prepared by conventional ethoxylation or propoxylation procedures. The chief requirement is that these reactants be proportioned such that the product fulfills the above requirements as regards average number of alkoxy groups per molecule. Thus ethylene oxide or propylene oxide can be reacted with diethylene triamine in proportions of 1 to 2 moles of the alkylene oxide per mole of the amine at appropriate reaction conditions. Distillation and/or other conventional purification procedures can be employed whenever necessary or desirable.

The acylation reaction itself is generally conducted at a temperature in the range of 140° to 200° C., with temperatures in the range 160° to 170° C. being preferred. The reaction can be conducted in the presence or absence of a solvent or reaction diluent. When using alkenyl succinic acylating agents in which the alkenyl substituent is derived from a polyolefin of lower molecular weight (e.g., a GPC number average molecular weight of 1300), it is preferred to conduct the acylation reaction in the absence of a reaction diluent, and to add a diluent, such as a process oil to the reaction product after it has been produced. On the other hand, with alkenyl succinic acylating agents in which the alkenyl substituent is derived from a polyolefin of somewhat higher molecular weight (e.g., a GPC number average molecular weight of 2100), it is desirable to conduct the reaction in a suitable diluent such as process oil or the like. It is important to proportion the reactants such that the product contains at least 2 moles of the acylating agent per mole of alkoxylated diethylene triamine. Ordinarily, the reactants should be proportioned such that the product contains no more than 3 moles of the acylating agent per mole of the alkoxylated diethylene triamine. It is desirable to feed the alkoxylated amine to the alkenyl succinic acylating agent portionwize over a suitable addition period while stirring and maintaining the reaction mixture at the selected reaction temperature. When conducting the reaction on a large scale, it is also desirable after the feed has been completed to stir the reaction mixture at the selected reaction temperature during a soak period of several hours before stripping off by-product water.

When conducting a post treatment pursuant to this invention, the dispersant formed as above is reacted with a suitable post-treating reagent such as are referred to in Table 4 of U.S. Pat. No. 5,137,980 using proportions and reaction conditions such as described in the appropriates patent document(s) cited in the said Table 4.

An advantage of the processing utilized in forming the dispersants of this invention is that the entire reaction can be conducted in a single reaction vessel suitably equipped with feeding means, stirring apparatus, heating means, vacuum lines and product discharge means.

A surprising feature of this invention is that the dispersants prepared as described herein are highly effective as dispersants, and do not require boration to render them stable and relatively passive toward fluoroelastomers. In this connection, it has been pointed out heretofore that products based on hydroxyalkylated polyamines have the drawback that they tend to attack engine seals, particularly those of the fluoropolymer type. See in this connection U.S. Pat. No. 4,873,009. That same patent, in describing highly effective dispersants based on use of alkylene diamines, emphasizes that the alkylene diamines must have an average of 2.5 to 4 N-hydroxyalkyl groups in order to provide an acceptable level of engine cleanliness, and that boration of the dispersant is necessary to stabilize the additive and reduce engine seal attack.

It is essential pursuant to this invention to form the dispersant by reaction between the polyalkenyl succinic acylating agent and a preformed hydroxyalkylated diethylene triamine, as this results in the formation of a product which has in the main a combination of imide, amide and ester linkages. Such a product cannot be formed by post-reacting a succinimide dispersant with an alkylene oxide such as ethylene oxide or propylene oxide as in U.S. Pat. Nos. 3,367,943; 3,373,111 and 4,234,435, or a succinic ester with the alkylene oxide as in U.S. Pat. Nos. 3,579,450 and 4,234,435.

The practice and advantages of this invention will become still further apparent from the following illustrative examples. It is to be understood that these examples do not constitute, are not intended to constitute, and should not be construed as constituting, limitations on the generic aspects of this invention.

Example I illustrates a typical procedure for producing a non-post-treated dispersant of this invention. Example II illustrates a one pot process for forming a post-treated dispersant of this invention. In these examples parts and percentages are by weight.

EXAMPLE I

Over a period of 40 minutes and with continuous stirring, 35.4 parts of diethylene triamine ethoxylated to the extent of 1.5 moles per mole (DETA-1.5 EO) is charged to 600 parts of polyisobutenyl succinic anhdride derived from polyisobutene having a number average molecular weight of approximately 1300 as determined by GPC (1300 PIBSA) maintained at 167° C. While holding the temperature at 167° C. the reaction mixture is then stripped for three hours. This forms a dispersant of this invention using the PIBSA and the DETA-1.5 EO in a mole ratio of 2:1 respectively. At this point 140 parts of process oil is added and the resultant solution is filtered to form a clear mineral oil solution of the dispersant.

EXAMPLE II

The procedure of Example I is repeated except that instead of adding the process oil, the stripped reaction product is cooled to 150° C. and 2 parts of maleic anhydride is added to the reaction product with stirring. The reaction mixture is then stirred for 0.5 hour and then stripped for 0.5 hour while maintaining the temperature throughout at 150° C. Then 160 parts of process oil diluent is added and the resultant solution is filtered to yield a clear oil solution of a post-treated dispersant of this invention.

The formation, properties and performance of a wide variety of typical dispersants of this invention are summarized in the tables below. The dispersants were produced using the general procedures given in Examples I and II above. The dispersants were then blended in a standard 15W-40 engine oil formulation from which the conventional ashless dispersant had been omitted, and the resultant fully formulated lubricants were then subjected to the Volkswagen P.VW 3334 Seal Test. In each case the dispersant was used at a concentration in the finished lubricant of 7 wt % (including the diluent oil associated with the dispersant). The finished lubricants were thus made up by weight of 72.4% 150 SN mineral oil, 5.0% 500 SN mineral oil, 9.7% OCP viscosity index improver, 1.31% zinc dialkyl dithiophosphate, 2.6% overbased calcium sulfonate, 0.64% low base calcium sulfonate, 0.8% phenolic antioxidant, 0.25% aromatic amine antioxidant, 0.004% antifoam agent, 0,296% process oil, and the 7% of dispersant under test, the proportions of the additive components being on an as received basis.

In the following tabulations the following abbreviations and conventions are used:

1) PIBSA represents polyisobutenyl succinic anhydride. A single asterisk after the designation of the quantity thereof used in the synthesis indicates that the PIBSA was derived from polyisobutene of 1300 GPC number average molecular weight; a double asterisk indicates that the PIBSA was derived from a 2100 GPC number average molecular weight polyisobutene.
2) DETA represents diethylene triamine.
3) EO indicates that the DETA has been ethoxylated and thus is N-substituted by one or more hydroxyethyl groups, the average number of which is indicated by the numeral preceding EO.
4) PO indicates that the DETA has been propoxylated and thus is N-substituted by one or more 2-hydroxypropyl groups, the average number of which is indicated by the numeral preceding PO.

5) MA represents maleic anhydride.
6) Mole ratios are given in the sequence of PIBSA: alkoxylated DETA, and where applicable, a third numeral in the ratio refers to the molar amount of MA.
7) Oil represents process oil diluent.
8) % N represents the weight percentage of nitrogen in the oil solution of the dispersant.
9) TBN represents the total base number expressed in terms of mg of KOH per gram of the oil solution of the dispersant, using the ASTM D2896 procedure.
10) TAN represents the total acid number expressed in terms of mg of KOH per gram of the oil solution of the dispersant, using the ASTM D664 procedure.
11) KV represents the kinematic viscosity of the oil solution of the dispersant in terms of centistokes at 100° C. using the ASTM D445 procedure.
12) % TS represents the percentage change (+ or −) in tensile strength of the VITON fluoroelastomer test specimens at test end in the Volkswagen test procedure P.VW 3334 as compared to tensile strength before test (below −20 is a failing result).
13) % EL represents the percentage change (+ or −) in elongation of the VITON fluoroelastomer test specimens at test end in the Volkswagen test procedure P.VW 3334 as compared to elongation before test: (below −25 is a failing result).
14) Cracking refers to whether cracks are observed in the VITON fluoroelastomer test specimens at test end in the Volkswagen test procedure P.VW 3334 (Yes represents a failing result).
15) Examples designated by numerals represent Examples of the invention whereas Examples designated by letters represent Comparative Examples not of the invention.
16) n.d. means not determined.

| Example | 1 | 2 | 3 |
|---|---|---|---|
| PIBSA, g | 500* | 661.5* | 300* |
| Amine | DETA-1 EO | DETA-1 EO | DETA-1.2 EO |
| Amine, g | 25.7 | 34 | 16.4 |
| MA, g | None | None | None |
| Mole ratio | 2:1 | 2:1 | 2:1 |
| Oil, g | 98 | 129.6 | 80 |
| % N | 1.1 | 1.16 | 1.09 |
| TBN | 11.8 | 13.2 | 16.1 |
| TAN | 3 | 3.6 | 0.8 |
| KV | 1919 | 2193 | 750 |
| % TS | −14 | −15 | −4 |
| % EL | −13 | −19 | −17 |
| Cracking | No | No | No |

| Example | 4 | 5 | 6 |
|---|---|---|---|
| PIBSA, g | 300* | 300* | 300* |
| Amine | DETA-1.3 EO | DETA-1.5 EO | DETA-1.5 EO |
| Amine, g | 16.8 | 17.7 | 17.7 |
| MA, g | None | None | None |
| Mole ratio | 2:1 | 2:1 | 2:1 |
| Oil, g | 80 | 78.5 | 78.5 |
| % N | 1.07 | 1.11 | 1.03 |
| TBN | 12.3 | 15.7 | 14.1 |
| TAN | 2.26 | 2.6 | 4.0 |
| KV | 1432 | 1307 | 1587 |
| % TS | −12 | −21 | −20 |
| % EL | −17 | −12 | −24 |
| Cracking | No | No | No |

-continued

| Example | 7 | 8 | 9 |
|---|---|---|---|
| PIBSA, g | 300* | 300* | 500* |
| Amine | DETA-1.5 EO | DETA-2 EO | DETA-1 PO |
| Amine, g | 15.4 | 16.0 | 28.2 |
| MA, g | None | None | None |
| Mole ratio | 2.3:1 | 2.5:1 | 2:1 |
| Oil, g | 80 | 80 | 91 |
| % N | 0.87 | 0.72 | 1.05 |
| TBN | 11.4 | 4.5 | 9.5 |
| TAN | 4.9 | 5.9 | 3.5 |
| KV | 1645 | 1053 | n.d. |
| % TS | −17 | −11 | −14 |
| % EL | −24 | −19 | −16 |
| Cracking | No | No | No |

| Example | 10 | 11 | 12 |
|---|---|---|---|
| PIBSA, g | 300* | 300* | 300** |
| Amine | DETA-1.2 PO | DETA-1.5 PO | DETA-1.5 EO |
| Amine, g | 18.2 | 16.0 | 8.87 |
| MA, g | None | None | None |
| Mole ratio | 2:1 | 2.5:1 | 2:1 |
| Oil, g | 80 | 80 | 93 |
| % N | 0.98 | 0.98 | 0.53 |
| TBN | 16.1 | 7.2 | 8 |
| TAN | 1.1 | 4.0 | 1.7 |
| KV | 721 | 1858 | 749 |
| % TS | −6 | −8 | −20 |
| % EL | −19 | −18 | −11 |
| Cracking | No | No | No |

| Example | 13 | 14 | 15 |
|---|---|---|---|
| PIBSA, g | 300* | 600* | 600* |
| Amine | DETA-1 EO | DETA-1.5 EO | DETA-1.5 EO |
| Amine, g | 20.6 | 35.4 | 35.4 |
| MA, g | 7.5 | 2 | 4 |
| Mole ratio | 1.5:1:0.55 | 2:1:0.1 | 2:1:0.2 |
| Oil, g | 120 | 157 | 157 |
| % N | 1.16 | 1.09 | 1.00 |
| TBN | 15.5 | 14 | 15.1 |
| TAN | 3.9 | 3.2 | 5.71 |
| KV | 901 | 1692 | 1499 |
| % TS | −15 | −5 | −5 |
| % EL | −24 | −18 | −2 |
| Cracking | No | No | No |

| Example | 16 | 17 | 18 |
|---|---|---|---|
| PIBSA, g | 300* | 300* | 300* |
| Amine | DETA-1.5 EO | DETA-2 EO | DETA-1.5 PO |
| Amine, g | 17.7 | 20 | 20 |
| MA, g | 2.97 | 5.1 | 5.1 |
| Mole ratio | 2:1:0.3 | 2:1:0.5 | 2:1:0.5 |
| Oil, g | 80 | 80 | 80 |
| % N | 1.09 | 0.98 | 1.08 |
| TBN | 13.8 | 17.5 | 10.6 |
| TAN | 3.6 | 7.1 | 2.7 |
| KV | 1814 | 2296 | 1458 |
| % TS | −10 | −14 | −10 |
| % EL | −14 | −26 | −17 |
| Cracking | No | No | No |

| Example | 19 | 20 | 21 |
|---|---|---|---|
| PIBSA, g | 300* | 300* | 1800** |
| Amine | DETA-1.5 PO | DETA-2 PO | DETA-1.5 EO |
| Amine, g | 20 | 23 | 53.2 |
| MA, g | 3.1 | 3.1 | 3.1 |
| Mole ratio | 2:1:0.3 | 2:1:0.3 | 2:1:0.1 |
| Oil, g | 79 | 80 | 558 |
| % N | 1.01 | 0.94 | 0.5 |
| TBN | 10.3 | 11.6 | 6.6 |
| TAN | 1.7 | 2.3 | 2.1 |
| KV | 1670 | 2121 | 602 |
| % TS | −9 | −17 | −10 |
| % EL | −15 | −18 | −23 |
| Cracking | No | No | No |

-continued

| Example | 22 | 23 | 24 |
|---|---|---|---|
| PIBSA, g | 700** | 200** | 3000** |
| Amine | DETA-1.5 EO | DETA-1.5 EO | DETA-1.5 EO |
| Amine, g | 20.7 | 5.9 | 91.3 |
| MA, g | 1.2 | 0.35 | 9.53 |
| Mole ratio | 2:1:0.1 | 2:1:0.1 | 2:1:0.2 |
| Oil, g | 217 | 62 | 1044 |
| % N | 0.52 | 0.5 | 0.52 |
| TBN | 7 | 6.4 | 8.1 |
| TAN | 1.4 | 2 | 1.4 |
| KV | 600 | 409 | 551 |
| % TS | −15 | −9 | −6 |
| % EL | −18 | −19 | −15 |
| Cracking | No | No | No |

| Example | 25 | 26 | A |
|---|---|---|---|
| PIBSA, g | 300** | 300** | 502* |
| Amine | DETA-1.5 EO | DETA-1.5 PO | DETA-1 EO |
| Amine, g | 8.87 | 9.98 | 34.4 |
| MA, g | 1.54 | 1.54 | None |
| Mole ratio | 2:1:0.3 | 2:1:0.3 | 1.5:1 |
| Oil, g | 93 | 93 | 200 |
| % N | 0.5 | 0.53 | 1.32 |
| TBN | 7.1 | 5.8 | 23.5 |
| TAN | 2.8 | 2 | 1.1 |
| KV | 1011 | 922 | 448 |
| % TS | −6 | −18 | −48 |
| % EL | −16 | −10 | −41 |
| Cracking | No | No | No |

| Example | B | C | D |
|---|---|---|---|
| PIBSA, g | 400* | 300* | 400* |
| Amine | DETA-1.75 EO | DETA-2 EO | DETA-1 PO |
| Amine, g | 25.2 | 20.1 | 30 |
| MA, g | None | None | None |
| Mole ratio | 2:1 | 2:1 | 1.5:1 |
| Oil, g | 105 | 79.1 | 177 |
| % N | 1.11 | 1.2 | 1.2 |
| TBN | 16.6 | 20.9 | 21.5 |
| TAN | 3.4 | 2.8 | 1.1 |
| KV | 1652 | 1742 | 341 |
| % TS | −23 | −46 | −25 |
| % EL | −37 | −37 | −29 |
| Cracking | No | Yes | No |

| Example | E | F | G |
|---|---|---|---|
| PIBSA, g | 300* | 400* | 300* |
| Amine | DETA-1.5 PO | DETA-1.75 PO | DETA-2 PO |
| Amine, g | 20 | 28.6 | 23 |
| MA, g | None | None | None |
| Mole ratio | 2:1 | 2:1 | 2:1 |
| Oil, g | 79 | 106 | 79.8 |
| % N | 1.07 | 1.07 | 1.16 |
| TBN | 12.4 | 12.9 | 15.3 |
| TAN | 0.5 | 3.1 | 1.8 |
| KV | 1385 | 1558 | 1378 |
| % TS | −25 | −22 | −29 |
| % EL | −22 | −39 | −26 |
| Cracking | No | No | No |

| Example | H | I | J |
|---|---|---|---|
| PIBSA, g | 241.4* | 205* | 400* |
| Amine | DETA-1 EO | DETA-1 PO | DETA-1 PO |
| Amine, g | 16.54 | 15.4 | 30 |
| MA, g | 3.3 | 2.8 | 9.1 |
| Mole ratio | 1.5:1:0.3 | 1.5:1:0.3 | 1.5:1:0.5 |
| Oil, g | 96.1 | 90.2 | 177 |
| % N | 1.34 | 1.29 | 1.12 |
| TBN | 17.1 | 14.2 | 19.6 |
| TAN | 1 | 1.3 | 5.1 |
| KV | 713 | 556 | 641 |
| % TS | −27 | −34 | −28 |
| % EL | −25 | −32 | −26 |
| Cracking | No | No | No |

It will be seen from the results set forth in the above tabulations that in every case except Examples 5 and 17, all of the compositions of this invention satisfied the requirements of the Volkswagen P.VW 3334 Seal Test, whereas all of the compositions not of this invention failed that test. Examples 5 and 17 were borderline results as they each fell below the test specifications by only 1%, and thus minor adjustments in formulation would be expected to enable those products to satisfy the test parameters.

The finished lubricants of Examples 12, 23, 24 and 25 were subjected to the more recent Volkswagen P.VW 3344 Seal Test and each of these compositions satisfied the requirements of this test as well.

The synthesis, properties and performance of borated dispersants of this invention are illustrated by Examples 27 and 28, tabulated below. These dispersants were produced generally in accordance with the procedure of Example II above, except of course the maleic anhdride was replaced by the borating agent, in this case boric acid. Here again the dispersants were used as the dispersant in the above SAE 15W-40 formulation and the resultant finished oils were subjected to the Volkswagen P.VW 3334 Seal Test.

In the following tabulations, the same abbreviations and conventions are used as in the preceding tabulations. Additionally, % B represents the weight percentage of boron in the oil solution of the dispersant.

| Example | 27 | 28 |
|---|---|---|
| PIBSA, g | 200** | 1500** |
| Amine | DETA-1.5 EO | DETA-1.5 EO |
| Amine, g | 5.9 | 44.25 |
| Mole ratio | 2:1 | 2:1 |
| Boric acid, g | 2.16 | 16.2 |
| Oil, g | 62 | 465 |
| % N | 0.47 | 0.53 |
| % B | 0.13 | 0.13 |
| TBN | 6.9 | 8.4 |
| TAN | 5.7 | 5.6 |
| KV | 993 | 543 |
| % TS | −15 | −12 |
| % EL | −6 | −15 |
| Cracking | No | No |

The formulations of Examples 27 and 28 met the requirements of the the Volkswagen P.VW 3334 Seal Test. When subjected to the newer more severe Volkswagen P.VW 3344 Seal Test, the formulation of Example 28 was unable to pass.

The formulations of Examples 23 and 28 were subjected to the Sequence VE engine test procedure and the were found to possess good dispersancy, varnish control and wear inhibition.

As used herein, the term "oil-soluble" means that the product under discussion can be dissolved or stably dispersed in a 100 Solvent Neutral mineral oil to a concentration of at least 1% by weight at 25° C.

What is claimed is:

1. An oil-soluble dispersant obtained by reacting a long chain alkyl or alkenyl succinic acylating agent with an alkoxylated diethylene triamine having an average of from 1 to 2 N-substituted $C_2$ or $C_3$ hydroxyalkyl groups per molecule, the reactants being employed in proportions of at least 2 moles of said acylating agent per mole of said alkoxylated diethylene triamine, with the proviso that where said average of N-substituted $C_2$ or $C_3$ hydroxyalkyl groups is 1.7 or more, said proportions are such that there are more than 2 moles of said acylating agent per mole of said alkoxylated diethylene triamine.

2. A dispersant according to claim 1 wherein said hydroxyalkyl groups are hydroxyethyl groups.

3. A dispersant according to claim 1 wherein said reactants are employed in proportions of from 2 to 2.5 moles of said acylating agent per mole of said alkoxylated diethylene triamine.

4. A dispersant according to claim 1 wherein said hydroxyalkyl groups are hydroxyethyl groups and wherein said reactants are employed in proportions of from 2 to 2.5 moles of said acylating agent per mole of said alkoxylated diethylene triamine.

5. A dispersant according to claim 1 wherein the average number of N-substituted $C_2$ or $C_3$ hydroxyalkyl groups per molecule of the dispersant is in the range of 1.1 to 1.6.

6. A dispersant according to claim 2 wherein the average number of N-substituted hydroxyethyl groups per molecule of the dispersant is in the range of 1.1 to 1.3.

7. A dispersant according to claim 2 wherein the average number of N-substituted hydroxyethyl groups per molecule of the dispersant is in the range of 1.4 to 1.6.

8. A dispersant according to claim 3 wherein the average number of N-substituted $C_2$ or $C_3$ hydroxyalkyl groups per molecule of the dispersant is in the range of 1.1 to 1.6.

9. A dispersant according to claim 8 wherein the average number of N-substituted $C_2$ or $C_3$ hydroxyalkyl groups per molecule of the dispersant is in the range of 1.1 to 1.3.

10. A dispersant according to claim 8 wherein the average number of N-substituted $C_2$ or $C_3$ hydroxyalkyl groups per molecule of the dispersant is in the range of 1.4 to 1.6.

11. A dispersant according to claim 1 wherein said acylating agent is derived from a polyalkene having a number average molecular weight in the range of 900 to 5000.

12. A dispersant according to claim 2 wherein said acylating agent is derived from a polyalkene having a number average molecular weight in the range of 1200 to 2500.

13. A dispersant according to claim 3 wherein said acylating agent is derived from a polyalkene having a number average molecular weight in the range of 1200 to 2500.

14. A dispersant according to claim 3 wherein said acylating agent is derived from a polyalkene having a GPC number average molecular weight that substantially corresponds to either 1300 or 2100.

15. A dispersant according to claim 11 wherein said acylating agent is a polyisobutenyl succinic acylating agent.

16. A dispersant according to claim 12 wherein said acylating agent is a polyisobutenyl succinic acylating agent.

17. A dispersant according to claim 13 wherein said acylating agent is a polyisobutenyl succinic acylating agent.

18. A composition which comprises a homogeneous mixture of oil of lubricating viscosity and a dispersant according to claim 1.

19. A composition which comprises a homogeneous mixture of oil of lubricating viscosity and a dispersant according to claim 4.

20. A composition which comprises a homogeneous mixture of oil of lubricating viscosity and a dispersant according to claim 12.

21. A composition which comprises a homogeneous mixture of oil of lubricating viscosity and a dispersant according to claim 13.

* * * * *